US008251738B2

(12) United States Patent
Heckert et al.

(10) Patent No.: US 8,251,738 B2
(45) Date of Patent: Aug. 28, 2012

(54) TERMINAL FOR CONNECTING LEAD ENDS

(75) Inventors: Michael Heckert, Eisenach (DE); Thomas Lang, Bischofroda (DE)

(73) Assignee: Weidmueller Interface GmbH & Co. KG, Detmold (DE)

( * ) Notice: Subject to any disclaimer, the term of this patent is extended or adjusted under 35 U.S.C. 154(b) by 0 days.

(21) Appl. No.: 13/126,224

(22) PCT Filed: Sep. 7, 2009

(86) PCT No.: PCT/EP2009/061535

§ 371 (c)(1), (2), (4) Date: Apr. 27, 2011

(87) PCT Pub. No.: WO2010/049197

PCT Pub. Date: May 6, 2010

(65) Prior Publication Data

US 2011/0207361 A1 Aug. 25, 2011

(30) Foreign Application Priority Data

Oct. 31, 2008 (DE) ..... 20 2008 014 469 U

(51) Int. Cl.
*H01R 11/20* (2006.01)

(52) U.S. Cl. ..... 439/441; 439/835

(58) Field of Classification Search ..... 439/436–441, 439/835

See application file for complete search history.

(56) References Cited

U.S. PATENT DOCUMENTS

| | | | | |
|---|---|---|---|---|
| 5,626,488 | A * | 5/1997 | Albeck et al. | 439/395 |
| 6,146,217 | A * | 11/2000 | Osada | 439/835 |
| 6,254,422 | B1 | 7/2001 | Feye-Hohmann | |
| 6,682,364 | B2 * | 1/2004 | Cisey | 439/441 |
| 6,851,967 | B2 * | 2/2005 | Miyoshi et al. | 439/441 |
| 7,287,999 | B2 * | 10/2007 | Holterhoff et al. | 439/441 |
| 7,329,143 | B2 * | 2/2008 | Schrader | 439/441 |
| 7,438,587 | B2 * | 10/2008 | Germani | 439/441 |
| 7,896,685 | B2 * | 3/2011 | Eppe et al. | 439/441 |

* cited by examiner

*Primary Examiner* — Truc Nguyen

(74) *Attorney, Agent, or Firm* — Lawrence E. Laubscher, Sr.; Lawrence E. Laubscher, Jr.

(57) ABSTRACT

An electrical connector for connecting the bare end of an insulated conductor with an electrical contact, including a connector housing containing a chamber in which are mounted a bus bar connected with the contact, and a clamping spring normally biased toward the bus bar. A retaining device maintains the spring in a retained open condition spaced from said bus bar, thereby to permit the conductor bare end to be introduced into the chamber toward a clamping position adjacent the bus bar. An operating member is displaced in a controlled manner to release the spring from its retained condition, whereby the spring biases the conductor toward electrical engagement with the bus bar. To remove the conductor, the operating member is operated again to displace the spring toward its open condition.

16 Claims, 13 Drawing Sheets

114
114a
114b
27a
27
14'
128
20a
20b
6a
6b
12'
28
25a
25b
26a
26b
20'
3a
3b
8
29
B
X
N
19'
21'

TERMINAL FOR CONNECTING LEAD ENDS

REFERENCE TO RELATED APPLICATIONS

This application is a 371 of PCT/EP2009/061535 filed Sep. 7, 2009, claiming priority of German Application No. DE 20 2008 014 469.8 filed Oct. 31, 2008.

BACKGROUND OF THE INVENTION

1. Field of the Invention

An electrical connector for connecting the bare end of an insulated conductor with an electrical contact, including a connector housing containing a chamber in which are mounted a bus bar connected with the contact, and a clamping spring normally biased toward the bus bar. A retaining arrangement maintains the spring in a retained open condition spaced from said bus bar, thereby to permit the conductor bare end to be introduced into the chamber toward a clamping position adjacent the bus bar. An operating member releases the spring from its retained condition, whereby the spring biases the conductor toward electrical engagement with the bus bar.

2. Description of Related Art

It is well known in the prior art to provide electrical connectors for connecting the bare end of an insulated conductor with an electrical contact by pressing the conductor into engagement with a bus bar that is connected with the contact.

However it is difficult in the known terminals to achieve good handling of the actuating element and, in particular, to achieve the opening position of the clamping spring with simple means in the disconnected state of the terminal, i.e. without a conductor, in which position a conductor can easily be inserted into, or removed from, the clamping site.

It is the object of this invention to solve this problem.

SUMMARY OF THE INVENTION

Accordingly, a primary object of the present invention is to provide an electrical connector for connecting the bare end of an insulated conductor with an electrical contact, including a connector housing containing a chamber in which are mounted a bus bar connected with the contact, and a clamping spring normally having a released closed condition biased toward the bus bar. Retaining means serve to retain the spring in a retained open condition spaced from said bus bar, thereby to permit the conductor bare end to be introduced into the chamber toward a clamping position between said clamping spring and the bus bar. An operating member is operable in a controlled manner to release the spring from its retained condition, whereupon the conductor is biased toward electrical engagement with said bus bar.

According to another object of the invention, the movement of the operating member is controlled by cam track and follower means. In one embodiment, the cam follower is mounted on the operating member, and the cam track is provided on a control member that is connected for sliding movement with the housing. In a second embodiment, the cam track is mounted on the operating member, and the cam follower is mounted on a control member that is connected for sliding movement relative to the housing.

According to a further object of the invention, the connector housing is provided with a plurality of clamping spring arrangements for biasing a number of conductors toward engagement with a plurality of bus bars, respectively.

In accordance with a more specific object, the operating element is configured in a controlled contour-guided manner, which can primarily be achieved in that the controlled contour-guided configuration includes a control cam and a projection that engages in the control cam, in particular, a cam follower.

The control cam can simply be configured such that the clamping spring can be retained in an open position so that the bare end of a conductor can be inserted into the open clamping site.

According to a preferred embodiment, the control cam is provided in a movable element, in particular, a sliding element, and the projection is provided on the operating member. Alternatively, the control cam can be on the operating member, and the projection on the sliding element.

According to another embodiment, a compact twin connector arrangement may be provided including a conductor insertion direction that is normal to the actuating direction, whereby two actuating elements are provided for separate actuation of two of the clamping springs that are arranged perpendicular to the lead insertion opening, respectively. Preferably, these two actuating elements are also configured in a controlled contour-guided manner.

A particularly stable and compact configuration is achieved if the two actuating elements—preferably made of a synthetic plastic material—each act on one of the clamping springs, respectively, via a bracket arm—preferably consisting of metal.

It is preferred that the operating element include a feed-through bore for the conductor, and that a stop be provided of the conductor insulation layer. The feed-through bore for the conductor preferably comprises a stepped configuration for this purpose and preferably has a surface in the contact area with the insulation of the lead that is used for transmitting force onto the clamping spring when pressure is applied to the conductor end.

According to another embodiment, the one spring, in particular the clamping spring, is configured to generate a restoring force required in the cam for indexing when the pinion is removed from a recess of the cam by renewed pressure onto the conductor end.

According to another feature, the connecting device of this type is configured such that the clamping site can be closed by applying pressure to the conductor end in the conductor insertion direction, and opened again by applying pressure to the conductor end once again. Connecting and disconnecting operations are thus achieved by simple constructive means without the use of tools.

BRIEF DESCRIPTION OF THE DRAWINGS

Other objects and advantages of the invention will become apparent from a study of the following specification, when viewed in the light of the accompanying drawing, in which.

DETAILED DESCRIPTION OF THE INVENTION

Figure 1A:
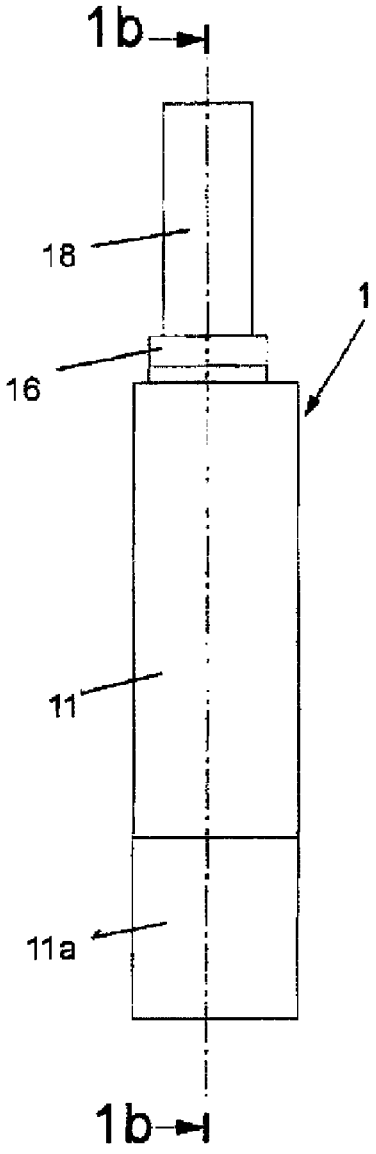
FIG. 1*a* is a front elevation view of the electrical connector in the retained open condition receiving an insulated conductor.
Figure 1B:
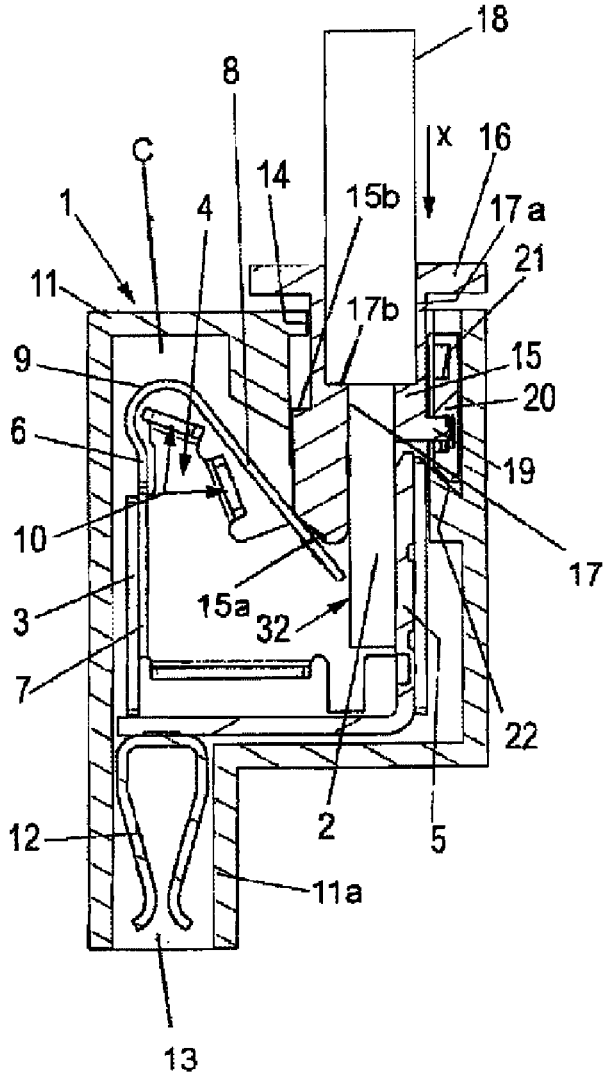
FIG. 1*b* is a sectional view taken along line 1*b*-1*b* of FIG. 1*a*.
Figure 1D:
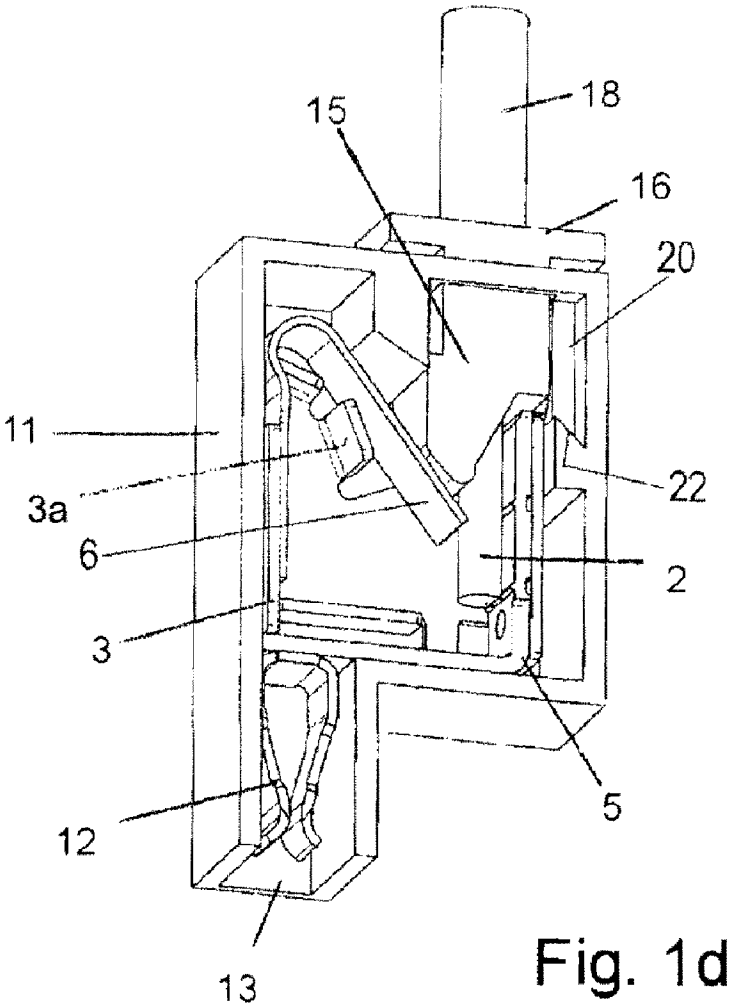
FIG. 1*d* is a perspective view of the connector of FIG. 1*c*
Figure 1C:
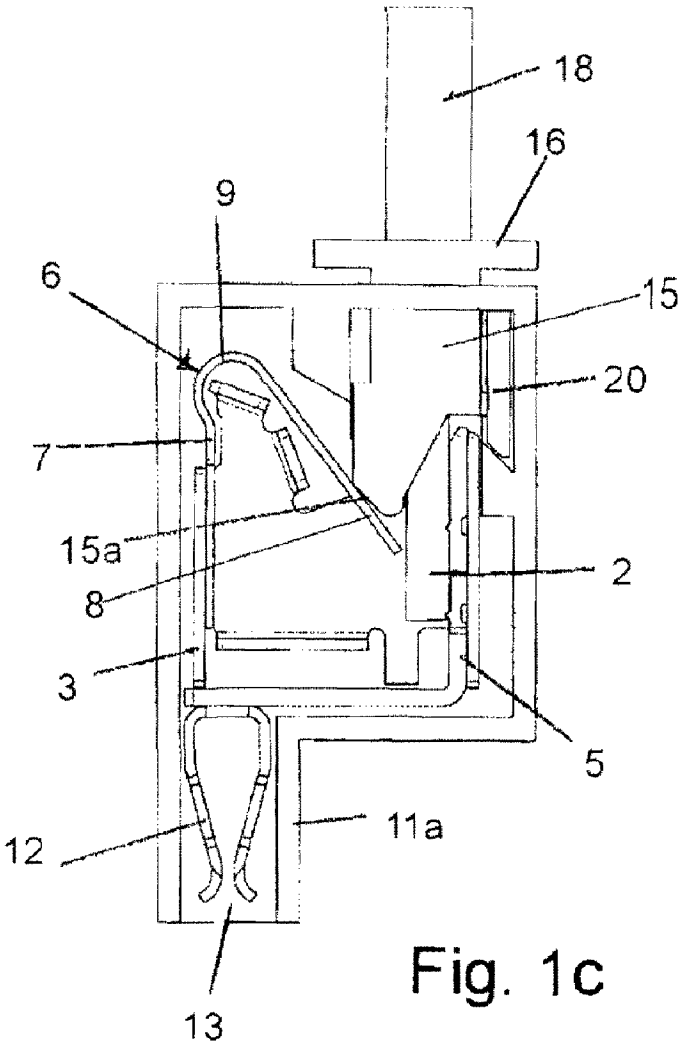
FIG. 1*c* is a side elevation view corresponding to FIG. 1*b*.
Figure 5:
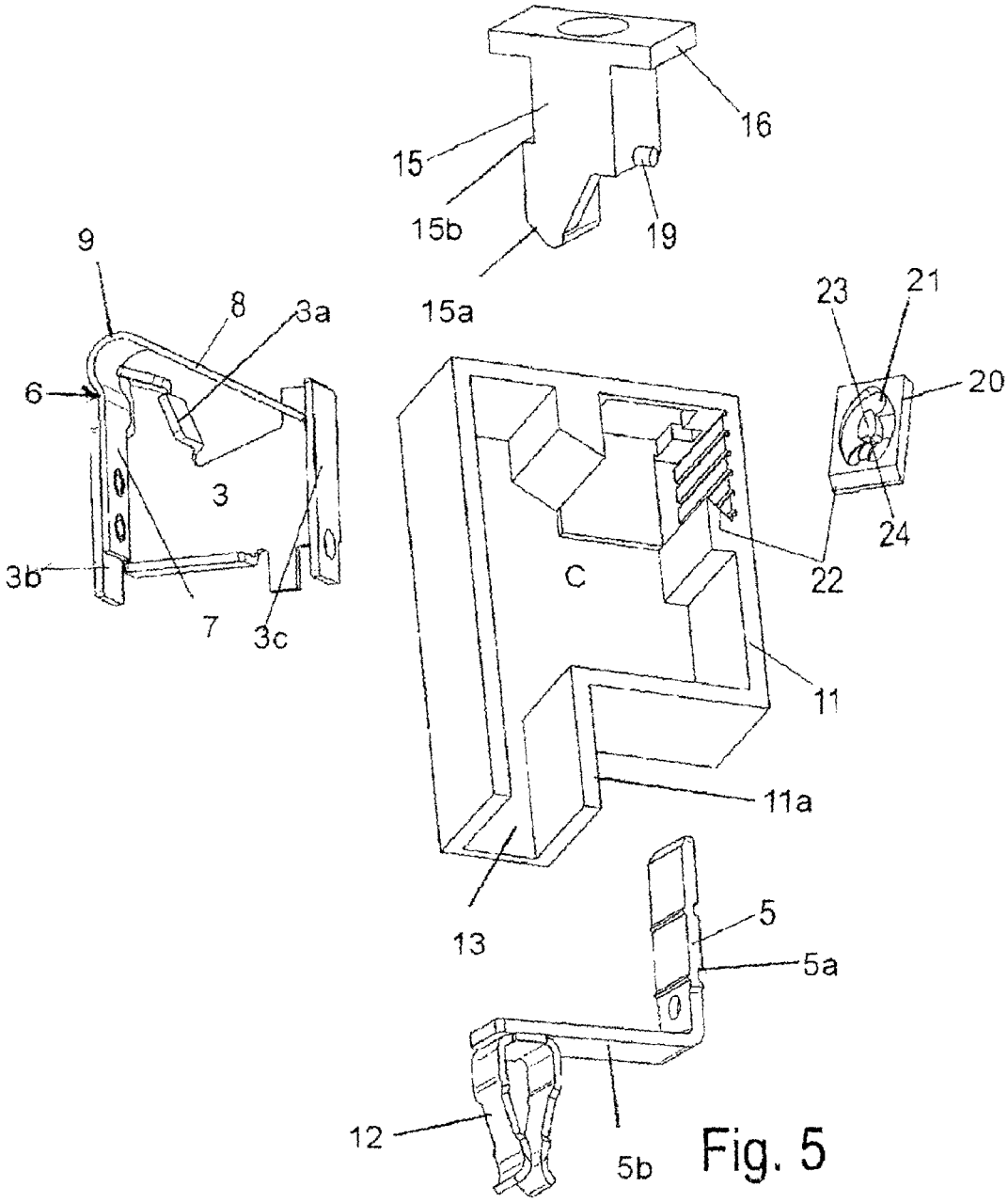
FIG. 5 is an exploded view of the apparatus of FIG. 4*a;*

Referring first more particularly to FIGS. 1*b* and 5, the electrical connector 1 includes a rectangular housing 11 formed of electrically insulating synthetic plastic material and containing a chamber C. Mounted for vertical sliding displacement in an opening 14 contained in the housing top wall is an operating member 15 having a top flange portion 16, and an inclined bottom surface 15*a*. A projection 19 defining a cam follower extends rigidly from one side wall of the operating member, and a stop surface 15*b* is defined by an abutment on the opposite side wall. As shown in FIG. 1*b*, the operating member contains a vertical through bore 17 having at its upper end a counterbore 17*a* that defines a bottom wall 17*b*.

Mounted in the housing chamber C is a bent sheet metal cage 3 having a first orthogonally bent stop flange 3*a*, and a pair of orthogonally bent parallel support flanges 3*b* and 3*c*. Secured to cage support flange 3*b* is one leg 7 of an inverted V-shaped leaf spring 6. The other leg 8 of the leaf spring is biased by connecting arch portion 9 outwardly toward the vertical arm 5*a* of an L-shaped bus bar 5 that is secured to the other cage support flange 3*c*. The horizontal other arm 5*b* of the bus bar extends along the housing bottom wall and is fastened to a female contact 12 that downwardly through a protective housing portion 11*a* toward a contact opening 13.

Figure 6A:
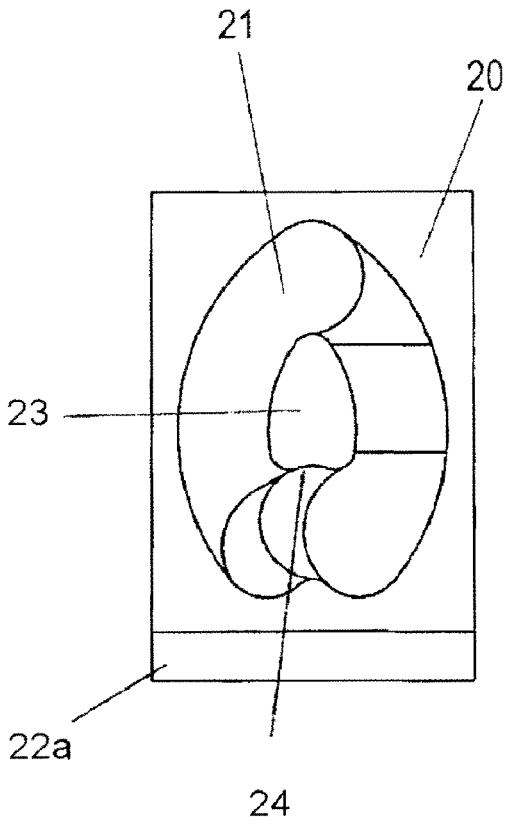
FIGS. 6*a* and 6*b* are side elevation and perspective views of the cam control member of FIG. 5.
Figure 6B:
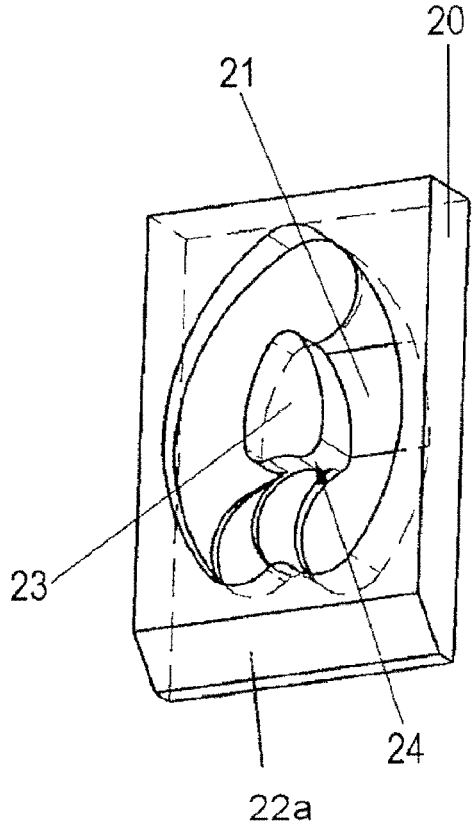
Figure 7A:
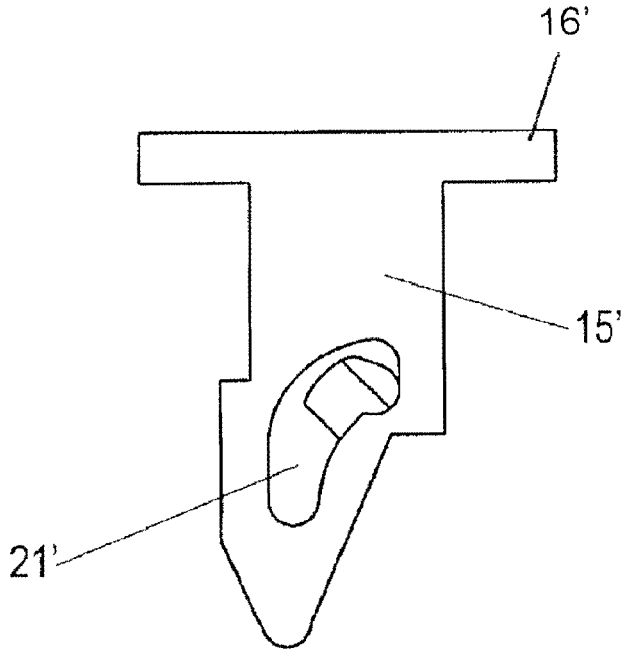
FIGS. 7*a* and 7*b* are side elevation and perspective views of a modification of the operating member of FIG. 5.
Figure 7B:
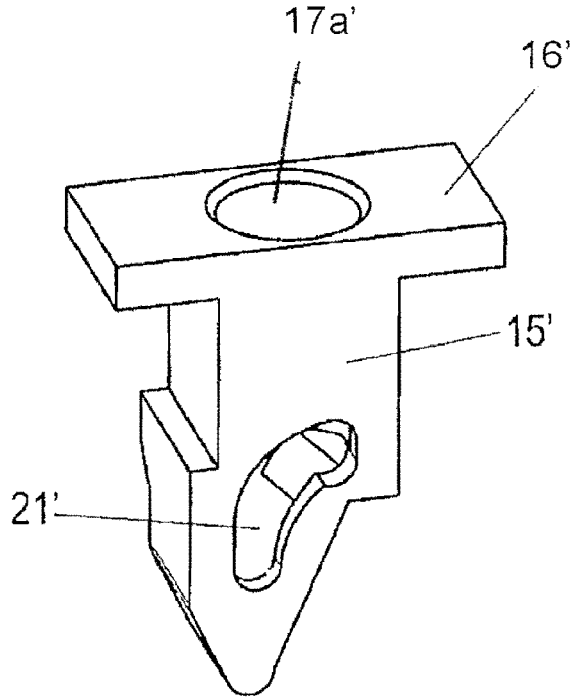

Connected by dovetail tongue and groove means 22 for sliding horizontal displacement relative to the housing end wall adjacent the conductor opening 14 is a control member 20. A cam track 21 is provided on the face of the control member 20 for receiving the cam follower 19 mounted on the operating member 15. As shown in FIGS. 6*a* and 6*b*, the cam track has a continuous generally-circular pattern surrounding a generally inverted-heart-shaped center portion 23 that contains a recess 24. As will be described below, the cam track pattern is such that the follower 19 travels in a given direction around the center portion 23.

Operation

Figure 2A:
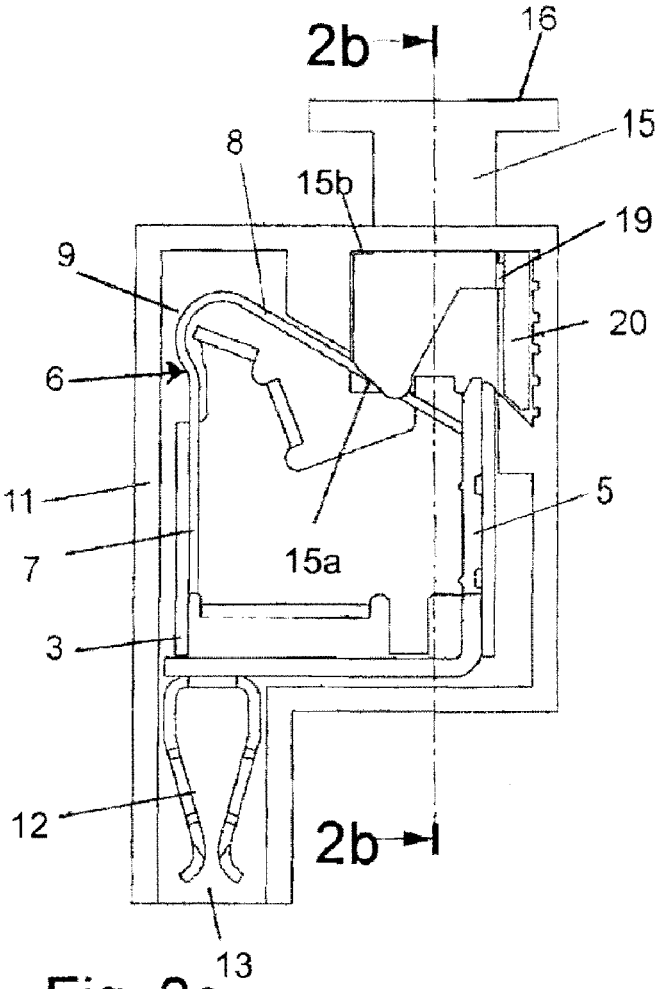
FIG. 2*a* is a sectional view of the connector of FIG. 1*b* when in the fully closed position.
Figure 3B:
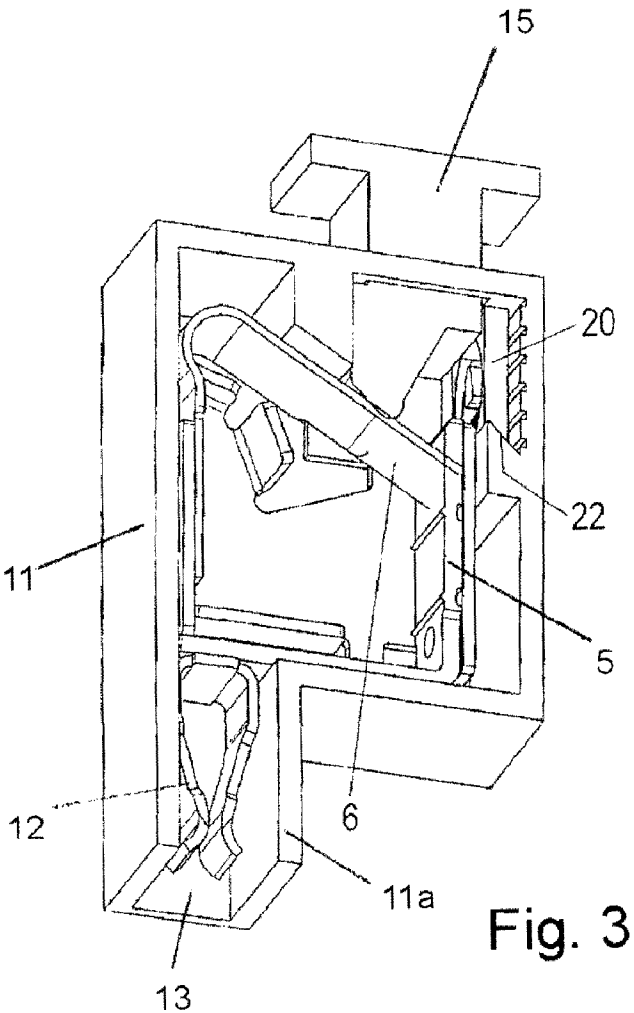
FIGS. 3*a* and 3*b* are perspective views of the connector of FIG. 2*a;*
Figure 3A:
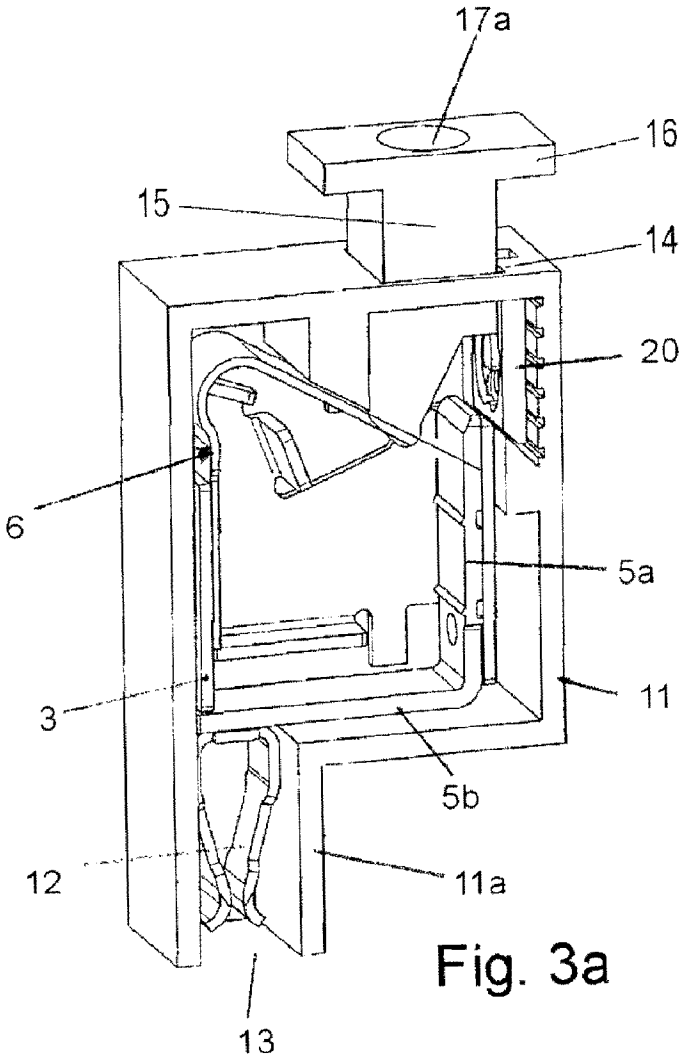
Figure 4B:
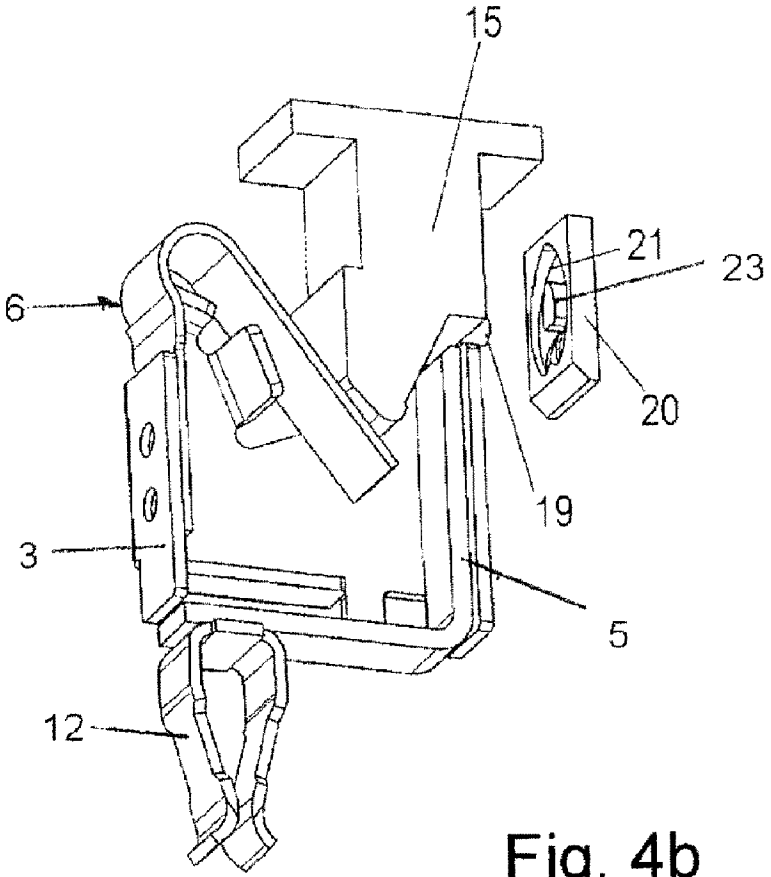
FIG. 4*b* is a detailed partially exploded perspective view of the apparatus of FIG. 4*a;*
Figure 4A:
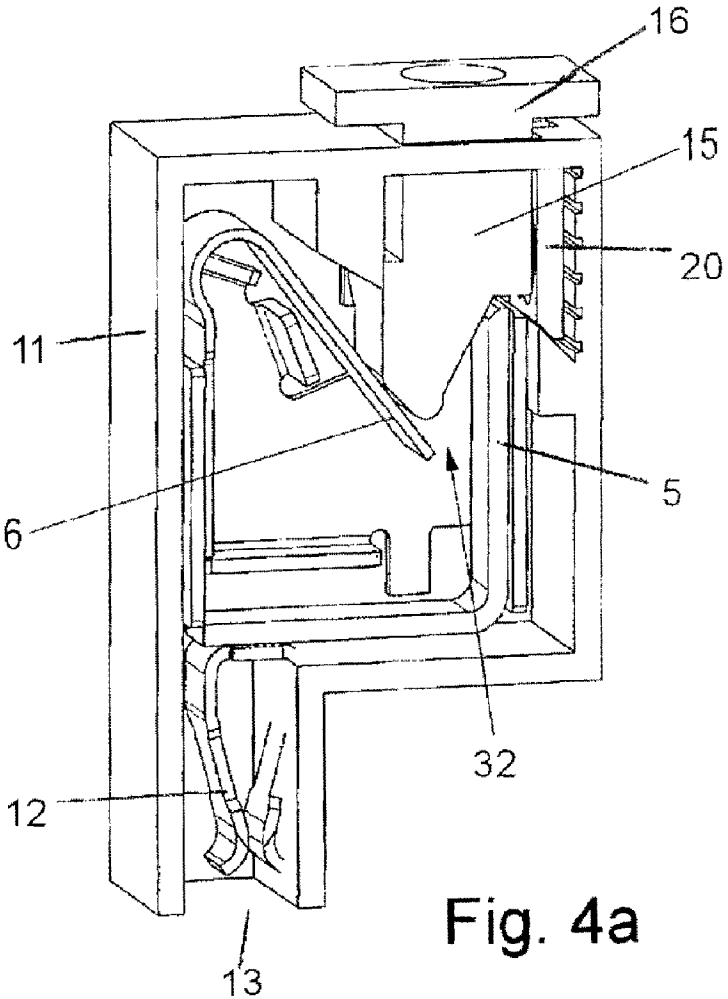
FIG. 4*a* is a perspective view corresponding to FIG. 1*b* with the conductor removed.

The spring leg 8 is normally biased toward the released closed condition of FIGS. 2*a* and 4*a*, wherein the free extremity of the leg 8 engages the bus bar 5, and the operating member is elevated (by the engagement of spring leg 8 with inclined surface 15*a*0 to its upper extent of travel, as determined by the stop surface 15*b* (FIGS. 2*a* and 3*a*). At this time, the cam follower 19 is in engagement with the uppermost point of the inverted heart-shaped center portion of the cam track. Upon the application of a downward force on the flange portion 16 of the operating member 15, the spring leg 7 and the operating member 15 are displaced downwardly toward the retained open position of FIG. 1*b*. Simultaneously with this downward movement, the control member 20 is slidably displaced to the right in FIGS. 3*a* and 3*b*, owing to the cooperation between cam follower 19 and cam track 21. When the cam follower 19 reaches a position beneath the recess 24, the downward pressure on the operating member is reduced, whereupon the operating member is biased upwardly by spring leg 8 to cause the cam follower to be seated in recess 24, thereby to retain the spring in the retained open condition.

The conductor is now displaced downwardly as shown by the arrow x to cause the bare end of conductor 2 to extend into the clamping region 32 (FIG. 1*b*). Upon further downward displacement of the conductor, the end of the insulation layer 18 engages the counterbore bottom wall, and as the conductor is further displaced downwardly, the spring leg 8 and the operating member are displaced downwardly, until cam follower projection 19 is displaced out of the recess 24. Owing to the configuration of the cam track 21, the operating member 20 is shifted relative to the housing 11, and upon release of pressure on the flange 16, the operating member is displaced upwardly until the extremity of spring leg 8 engages the bare conductor end and biases the same toward lateral electrical engagement with the bus bar 5, thereby connecting the conductor with the contact 12.

To disconnect the conductor from the connector, the conductor is displaced downwardly to displace the spring leg 8 away from the bare conductor end, and the follower engages the cam track 21 to return the control member to a position in which the recess 24 is above the cam follower 21, whereupon the operating member is released, and the spring is in the retained open condition of FIG. 1*b*.

The clamping cage 3 is shown in a preferred—but not mandatory—configuration normal to the conductor insertion direction X in closed condition. But it can also just comprise less side walls and for example have a C shape in this sectional view. It is preferably configured in such a way that it at least performs the functions of supporting the clamping spring for absorbing the clamping and contact forces, and supporting the bus bar or bus bar function. It is preferred that a section of a bus bar 5 that serves as the section to be contacted by the lead end or as a contacting abutment projects into the clamping cage 3.

Alternatively, it is conceivable that the clamping cage 3 itself assumes an electricity-conducting function if it is made of, or coated with, an electro-conductive material. One or several stops 10 that are preferably designed as holes punched into the walls of the clamping cage 3 perform an opening limiting function for the clamping spring 6.

The operating member 15 itself encompasses a feed-through 17 through which the lead end 2 can be guided into the clamping site 32 between the bus bar 5 and the clamping spring 6. The feed-through 17 may comprise a tapering or stepped reduction in cross-section, thus forming a stop for an insulation 18 of the lead which can optionally ensure the transmission of force from the lead end to the actuating element when the lead end is pressed down.

The operating member 15 is configured as a pushbutton the one end of which rests on the clamping leg 8 and acts on it when pressed down and the other end of which is used to apply a pressure force to the pushbutton 15, e.g. using a tool such as a screwdriver, is provided to move the free end of the clamping spring 6 from a position near, or in direct contact with, the bus bar 5 to a position more distant from the bus bar 5, i.e. an opening position in which the lead end can inserted into the clamping site 32 or removed from the clamping site 32 (FIG. 4). The pushbutton 15 can be moved parallel to the lead insertion direction X and is guided in a corresponding contour or hole 14 of the housing 11.

In addition, the actuating element 15 is particularly advantageously configured in a controlled contour-guided manner. This is achieved by equipping the actuating element 15 with a molded-on or attached protrusion, here a pinion 19, which engages in a control cam 21 formed in a movable element, particularly in a sliding element 20, wherein the sliding element 20 is movably guided like a carriage normal to the conductor insertion direction along (or here, in) a guide 22 of the housing 11.

Figure 2B:
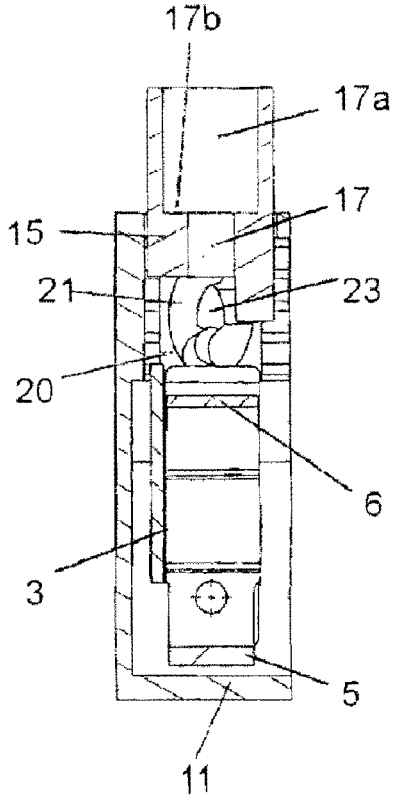
FIG. 2*b* is a sectional view taken along line 2*b*-2*b* of FIG. 2*a*.
Figure 2C:
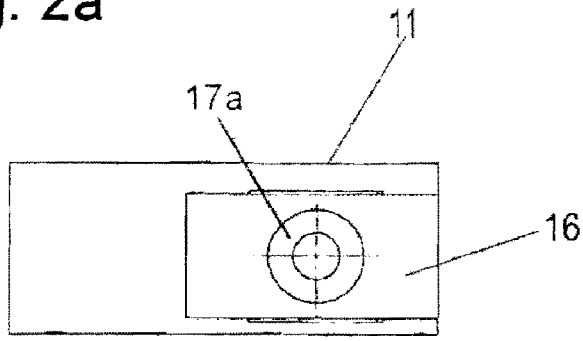
FIG. 2*c* is a top view of the apparatus of FIG. 2*a;*

The sliding element 20 and the guide 22 in the housing 11 are of the dovetail type (based on a corresponding groove-and-tongue principle) wherein the guide 22 extends perpendicular to the lead insertion direction X so that the sliding element 20 can be moved perpendicular to that direction (in FIG. 1 perpendicular to the sheet plane). The control cam 21 is configured such that the pinion 19 can be locked—preferably audibly and/or by feel—into the movable sliding element 20 in the opening position for inserting or removing the conductor end 2 (FIGS. 2, 4).

It is also conceivable that the control cam 21 is configured such that the follower 19 also locks into place in the control cam in the closing position or contact position. Here the control cam 21 comprises a heart-shaped curvature (see FIG. 6*a*) through which the follower 19 passes during opening and closing so that the sliding element 15 is moved accordingly perpendicular to the image plane. A heart-shaped center portion 23 whose recess 24 is used as a contact surface for the pinion 19 and the pushbutton 15 in the opening position is formed in the center of the control cam 21.

In the initial closed position in which the clamping spring 6 rests against the bus bar 5, the follower 19 is positioned in the upper tip of the heart-shaped control cam 21 in the figure. The pushbutton 15 is pushed down in lead insertion direction X to open the clamping site 32 and to lock the pushbutton 15 into place in the opening position. In this process, the follower 19 moves through the control cam 21, which also moves the sliding element 20 along. In the opening position, the sliding element 20 then moves proximate to the recess 24 where it remains after the pressure onto the operating member 15 lets off so that the operating member 15 is pushed upwardly into the recess 24 by the spring force of the clamping spring 24. In this position, the conductor bare end 2 can be conducted into the clamping site 32.

Pressure is applied again to the operating member 15 to release the follower 19 or the opening position, respectively. Since the continuous control cam track 21 also comprises an appropriate height contour, the follower 19, after leaving the recess 24 in the heart-shaped curve, moves in counterclockwise direction to the increasingly deeper region of the control cam 21 in the embodiment selected here (FIG. 5) and passes through this region on the opposite side of where it moved during the push into the opening position. If the pressure onto the actuating element 15 stops, the clamping spring 6 is released and the conductor bare end is pressed against the bus bar 5 and make electric contact.

Figures 8A, 8B, 8C, 8D, 8E, 8F:
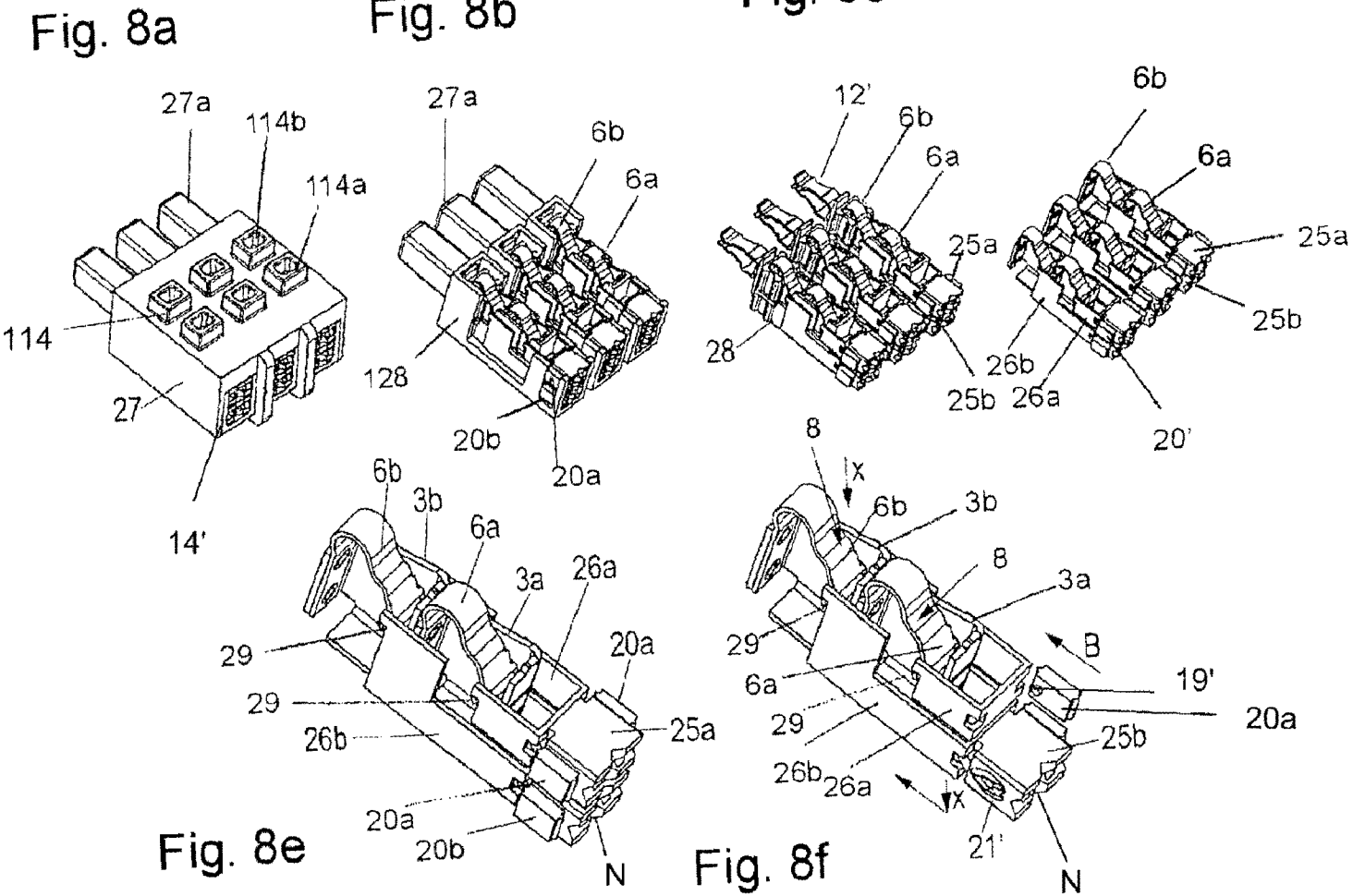
FIGS. 8*a*-8*d* are perspective views illustrating the assembly steps for producing a second embodiment of the electrical connector of the present invention.
FIG. 8*e* is an enlarged view of one of the clamping spring assemblies of FIG. 8*a*.
FIG. 8*f* is a corresponding view with certain parts removed.

Inverse arrangements are conceivable in which a control cam track 21 is provided in the actuating element 15 and a follower is provided in the sliding element 15 (see FIG. 7 or FIGS. 8-10 that show actuating elements with such control cams 21' and in which the sliding element 20' includes the follower 19' (see FIG. 8*e*). It is further conceivable to provide control cams 21 with other forms or contours and to arrange them on the another side of the operating member 15.

Referring now to FIGS. 8*a*-8*f*, according to an alternate embodiment of the invention, a number of clamping spring and bus bar arrangements may be mounted in a rectangular housing 27 (FIG. 8*a*) containing on its top wall a plurality of conductor openings 114 for introducing the conductor bare ends in a direction normal to the operation of the operating members 25. Referring to FIG. 8*d*, a plurality of devices are proved each having two clamping springs 6*a* and 6*b* arranged longitudinally of two vertically stacked operating members 25*a* and 25*b*. These operating members longitudinally displace upper and lower bracket members 26*a* and 26*b* (FIGS. 10*c* and 10*f*) having abutments 30 at their ends for engagement with lateral tab portions 29 (FIG. 10*e*) on the clamping springs, thereby to displace the spring legs 6' away from the associated bus bars, respectively. Cam tracks 21' on the operating members 25 (FIG. 10 *d*) engage the corresponding followers 19' on the corresponding sliding members 20' (FIG. 8*f*) to shift the sliding members relative to frames 28 (FIGS. 8*c* and 10*a*) and 128 (FIG. 8*b*), thereby to retain the springs in the open retained condition. The sub assemblies of FIG. 8*b* are then inserted within the housing open rear end to complete the assembly of FIG. 8*a*. The various bare ends of the insulated conductors are then inserted via openings 114 between the retained open spring ends and the bus bars in a manner corresponding to that shown in FIG. 1*b*.

According to FIGS. 8*a* to 8*f*, the pushbutton 25 is configured in such a way that it is moved into a direction B that is normal to the lead insertion direction X.

A bracket 26, one section of which engages normal to the conductor insertion direction in an opening or window of the clamping cage 3, is provided for this purpose on the operating member 25. If the operating member 25 is moved in the direction B, the bracket 26 moves along with it and presses the clamping leg of the clamping spring away from the bus bar 5. The clamping site therefore can be opened again by pushing the button. It is advantageous if the bracket 26 comprises a stepped contour 20 that acts on lateral projections 29 of the clamping spring.

Figure 9:
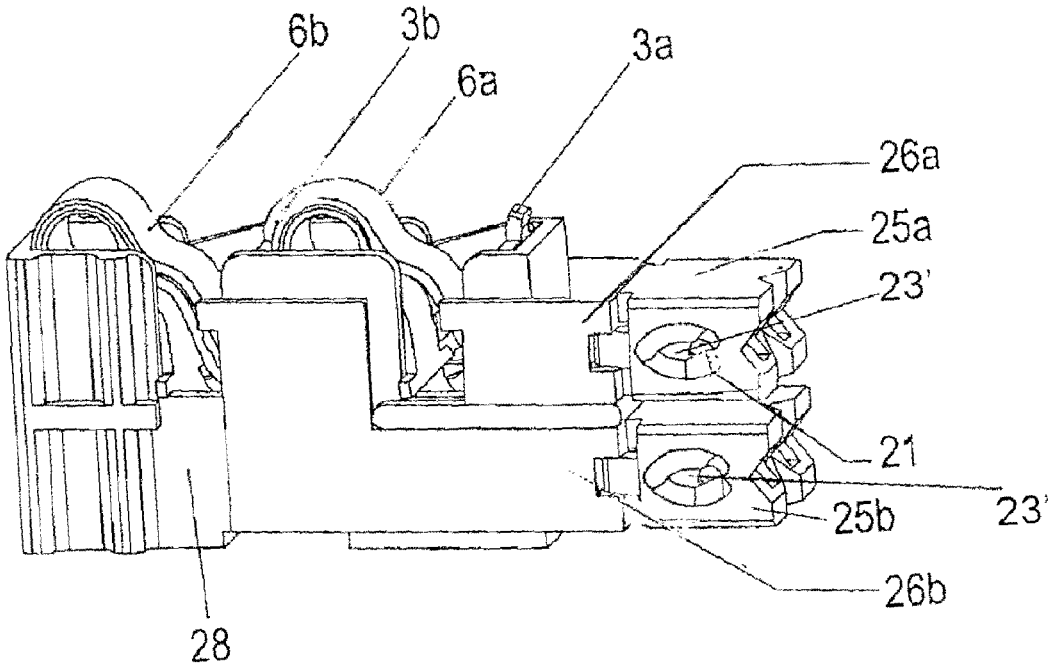
FIG. 9 is a perspective view of one of the frame assemblies of FIG. 8*b* with certain parts removed.
Figure 10A:
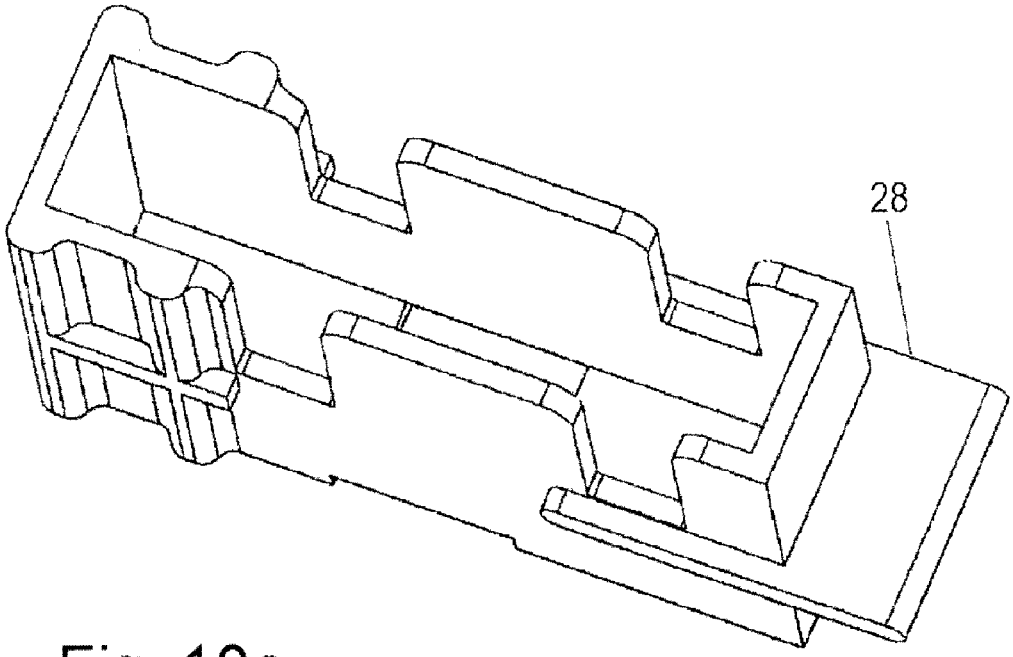
FIG. 10*a* is a perspective view of the frame of FIG. 9.
Figure 10B:
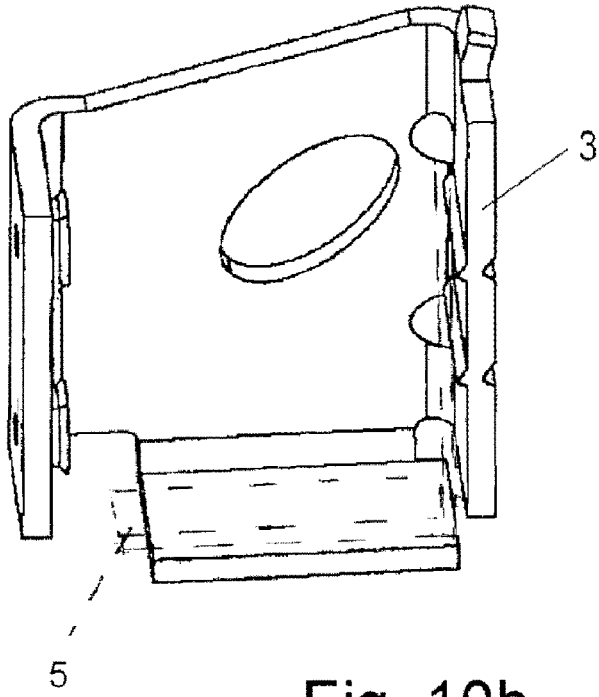
FIG. 10*b* is a perspective view of one of the cage members of FIG. 9.
Figure 10C:
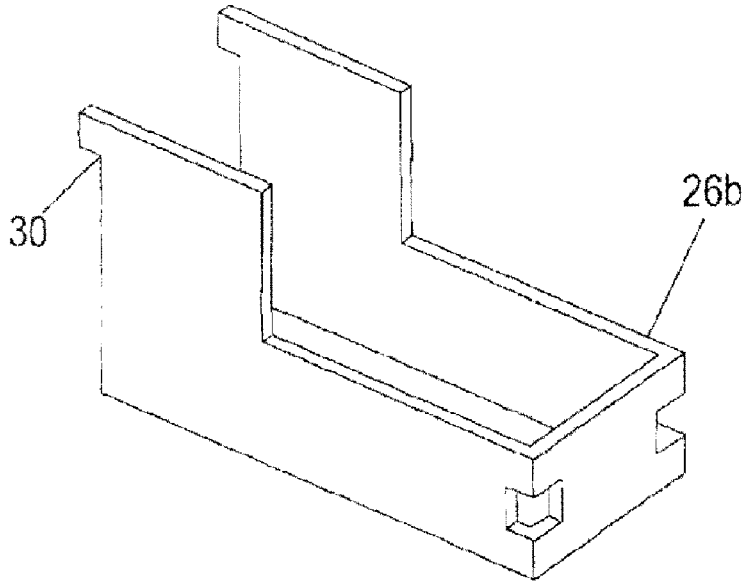
FIG. 10*c* is a perspective view of one of the operating brackets of FIG. 9.
Figure 10D:
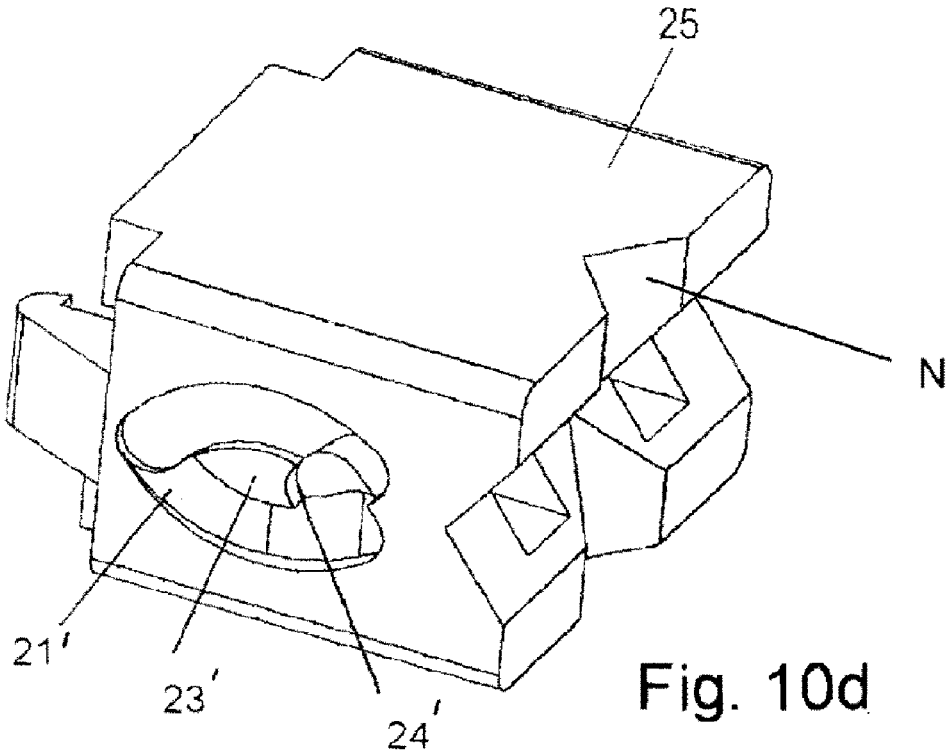
FIG. 10*d* is a perspective view of one of the operating members of FIG. 9.
Figure 10E:
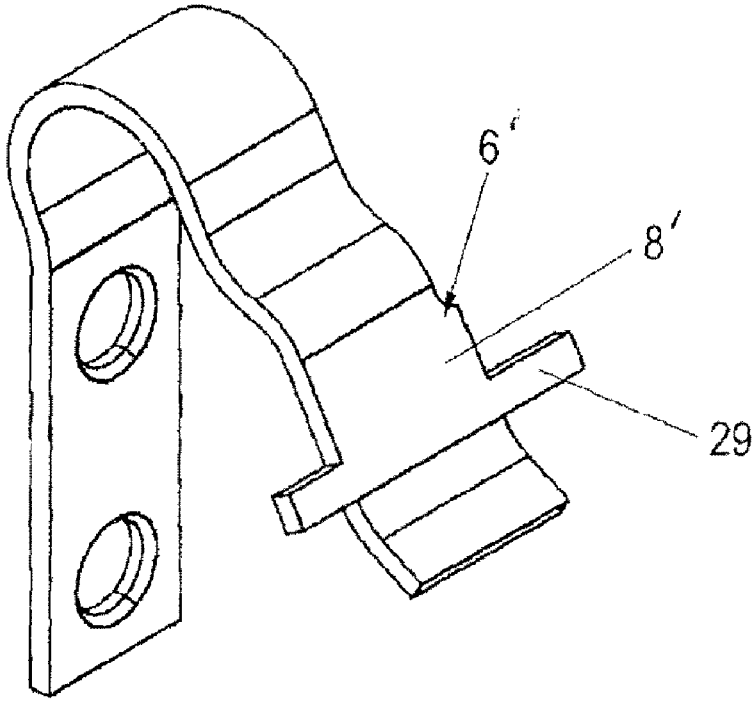
FIG. 10*e* is a perspective view of one of the clamping springs of FIG. 9.
Figure 10F:
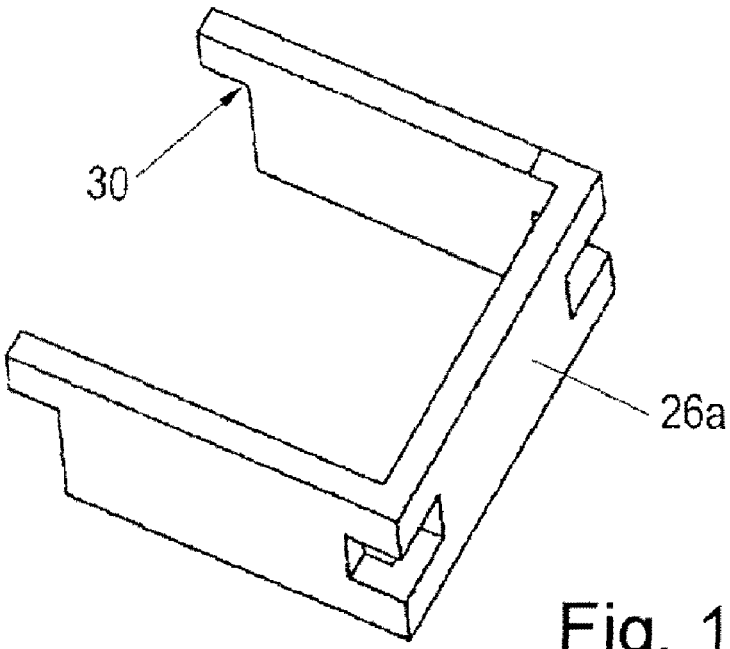
FIG. 10*f* is a perspective view of a second one of the operating brackets of FIG. 9.

As can further be seen in FIGS. 8 to 10, a particular advantage of these terminals is that they are configured as multiple connectors, in this case twin connectors, wherein the clamping cage is designed such that it can house two clamping springs 6 and bus bars 5 arranged at a lateral offset to one another in actuating direction of the actuating element. Accordingly, two actuating elements 25*a* and 25*b* are provided. These actuating elements 25*a* and 25*b* are located on one side of the clamping cages 3*a*, 3*b* to allow operation from the side, which is particularly advantageous. To still be able to open both clamping springs 6*a*, 6*b* or clamping sites, the brackets 26*a*, 26*b* are formed differently such that the one bracket 26*a* acts onto the one clamping spring 6*a*, and the other bracket 26*b* onto the other clamping spring 6*b*. The brackets 26 are preferably locked into place on the actuating elements 25 but they can also be formed in one piece with them. The actuating elements 25 may comprise a contour for applying a screwdriver to them.

Actuating elements 25*a*, 25*b* once again are configured in a controlled contour-guided manner, for which purpose two control cams 21 are formed directly onto the actuating elements 25*a*, 25*b*—again in heart-shaped configuration—that interact with followers 19' FIG. 8*f*) of two sliding elements 20*a*, 20*b* that are movably guided in respective guides in an outer housing 27. A frame 28 that houses the clamping cages 3 is seen next to the outer housing 27 so that the housing here is made up of the frame components 28 and 128, and the outer housing 27.

The actuating elements 25 once again can be locked into place in opening position so that the clamping sites can be opened separately to deliver the terminal in this condition to the customer and/or to make handling simpler. For stability reasons, the brackets 26 can be made of metal and the actual actuating elements 25 can be made of plastic.

As is apparent from FIG. 8, the outer housing 27 can be designed such that it comprises multiple chambers, each of which receiving a single or twin connector. The figure shows three twin connectors in a single outer housing 27. It would also be conceivable to open two clamping springs at the same time with one actuating element 25 if the latter comprised two brackets.

The control cam track 21 is preferably configured so that the pushbutton can be released from its locked position just by pressing it in the conductor insertion direction X, e.g. to contact a conductor inserted into the clamping site, for which the clamping spring 6 has to be released.

While the above embodiments refer to a connecting device in which the clamping spring acts as a compression spring, the invention can also be applied to embodiments in which the clamping spring is configured as a tension spring (not shown here).

While in accordance with the provisions of the Patent Statutes the preferred forms and embodiments of the invention have been illustrated and described, it will be apparent to those skilled in the art that changes may be made without deviating from the invention described above.

What is claimed is:

1. An electrical connector for connecting the bare end of an insulated conductor (2) to a contact (12), comprising:

(a) a connector housing (11; 27) containing a chamber having walls;

(b) cage means (3; 3') including a bus bar (5; 5') mounted in said chamber, said housing chamber including a wall containing a conductor opening (14; 114) for introducing the conductor bare end into said chamber toward a clamping position (32) adjacent said bus bar, said cage means further including an electrical contact (12; 12') connected with said bus bar, said contact being arranged in a contact opening (13, 13') contained in a wall of said housing chamber;

(c) a clamping spring (6; 6*a*, 6*b*) mounted in said chamber, said clamping spring normally having a released closed condition in which said clamping spring is biased toward with said bus bar;

(d) retaining means (19, 24; 19', 24') for retaining said spring in a retained open condition spaced from said bus bar, thereby to permit the conductor bare end to be introduced between said clamping spring and said bus bar; and (e) release means for releasing said spring from said retained condition, thereby to bias the conductor toward electrical engagement with said bus bar, said release means including:

(1) an operating member (15; 25); and (2) control means (21; 21') controlling the movement of said operating member relative to said housing, said control means comprising cam track means (21; 21'), and a cam follower (19; 19') extending into said cam track means.

2. An electrical connector as defined in claim 1, wherein said cam follower (19) is arranged on said operating member (15), and said cam track means (21) is supported on a movable control member (20); and connecting means (22) connecting said control member for sliding movement relative to said housing.

3. An electrical connector as defined in claim 1, wherein said cam follower means (19') is arranged on a movable control member (20; 20*a*, 20*b*) that is slidably connected with said housing, and said cam track means (21') is mounted on said operating member (15; 25*a*, 25*b*).

4. An electrical connector as defined in claim 2, wherein said connecting means comprises dovetail tongue and groove guide means (22).

5. An electrical connector as defined in claim 4, wherein said cam track means has a continuous generally circular path.

6. An electrical connector as defined in claim 5, wherein said cam track path surrounds a center portion (23) having a generally inverted heart-shaped configuration containing a bottom recess (24) that receives said cam follower when said spring is in said retained open condition.

7. An electrical connector as defined in claim 6, wherein said cam path is such that said cam follower travels in only one generally circular direction along said cam track.

8. An electrical connector as defined in claim 7, wherein said cam follower engages the upper pointed end of said cam track center portion when said spring is in said closed condition.

9. An electrical connector as defined in claim 8, wherein said operating member (15) is vertically arranged and slidably mounted in said conductor opening, said operating member containing a through bore (17) that is provided at its upper end with a counterbore (17*a*) having a bottom wall (17*b*) defining a stop surface, whereby when the insulated conductor is inserted downwardly with the bare end portion thereof extending through said though bore toward said chamber clamping position (32), the conductor insulation layer engages said counterbore bottom wall stop surface when said conductor is in said retained open condition.

10. An electrical connector as defined in claim 8, wherein said clamping spring comprises an inverted V-shaped leaf spring having:

(1) a first leg portion (7) generally parallel with, and spaced from, said bus bar, said first leg being fixed to said cage means, and (2) a second leg portion (8) biased toward said bus bar;

(3) said operating member having a lower surface (15*a*) in engagement with said spring second leg portion, whereby said operating member is normally biased upwardly by said spring relative to said housing, said operating member being downwardly displaceable by the conductor to lower the follower from said recess, whereby the operating member is displaced upwardly to release said spring from its retained condition.

11. An electrical connector as defined in claim 10, whereby when said clamping spring is in the released condition biasing the conductor toward engagement with the conductor bare end, in order to remove the conductor from the chamber, the operating member is displaced downwardly to reset the spring to its retained condition.

12. An electrical connector as defined in claim 11, wherein said operating member includes a flange portion (16) limiting the extent of downward travel of said operating member relative to said housing.

13. An electrical connector as defined in claim 12, wherein said operating member includes a stop abutment (15*b*) limiting the extent of upward movement of said operating member relative to said housing.

14. An electrical connector as defined in claim 12, wherein said cage means includes stop means (3*a*) limiting the extent of displacement of said spring second leg toward said spring first leg.

15. An electrical connector as defined in claim 3, wherein said housing (27) is horizontal and generally rectangular; and wherein said electrical connector further includes:

(d) at least two of said operating members (25*a*, 25*b*) arranged in superposed relation in an opening contained in a vertical end wall of said housing (27);

(e) a pair of longitudinally arranged cage means (3*a*, 3*b*) associated with said operating elements, each of said cage means including a bus bar, respectively;

(f) a pair of said clamping springs (6*a*, 6*b*) associated with said cage means, respectively;

(g) a pair of said retaining means (26*a*, 26*b*) associated with said clamping springs, respectively, said housing having a top wall containing a pair of said conductor openings (114*a*, 114*b*) for introducing the bare ends of two conductors between said clamping springs and said bus bars, respectively, when said clamping springs are in said retained open condition, respectively; and (h) a pair of said control means (21') controlling the movement of said operating members relative to said housing, respectively.

16. An electrical connector as defined in claim 15, wherein said retaining means include a pair of parallel bracket arms arranged on opposite sides of said clamping springs.

* * * * *